US010964521B2

(12) United States Patent
Fukui

(10) Patent No.: US 10,964,521 B2
(45) Date of Patent: Mar. 30, 2021

(54) MASS SPECTROMETER

(71) Applicant: SHIMADZU CORPORATION, Kyoto (JP)

(72) Inventor: Wataru Fukui, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 16/626,618

(22) PCT Filed: Jul. 18, 2017

(86) PCT No.: PCT/JP2017/025900
§ 371 (c)(1),
(2) Date: Dec. 26, 2019

(87) PCT Pub. No.: WO2019/016851
PCT Pub. Date: Jan. 24, 2019

(65) Prior Publication Data

US 2020/0161120 A1 May 21, 2020

(51) Int. Cl.
*H01J 49/04* (2006.01)
*H01J 49/46* (2006.01)
(Continued)

(52) U.S. Cl.
CPC ..... *H01J 49/424* (2013.01); *H01J 49/0495* (2013.01); *H01J 49/066* (2013.01)

(58) Field of Classification Search
CPC .... H01J 49/424; H01J 49/0495; H01J 49/066; H01J 49/06
(Continued)

(56) References Cited

U.S. PATENT DOCUMENTS 5,652,427 A 7/1997 Whitehouse et al.
5,962,851 A 10/1999 Whitehouse et al.
(Continued)

FOREIGN PATENT DOCUMENTS

CA 2 656 956 A1 8/1995
DK 748249 T3 12/1996
(Continued)

OTHER PUBLICATIONS

International Search Report for PCT/JP2017/025900 dated Oct. 17, 2017 [PCT/ISA/210].
(Continued)

*Primary Examiner* — Nicole M Ippolito
(74) *Attorney, Agent, or Firm* — Sughrue Mion, PLLC

(57) ABSTRACT

The mass spectrometer includes an ionization unit, an ion transport unit, and a mass separation unit that separates transported ions according to a mass-to-charge ratio. The ion transport unit includes a transport electrode member, a voltage generator that applies a voltage to the transport electrode member, and a voltage controller that changes a voltage applied to the transport electrode member while ionization is performed. The voltage controller switches between a first voltage state in which charged particles generated in the ionization unit can enter the mass separation unit, and a second voltage state in which the charged particles cannot enter the mass separation unit, and switches a voltage state of the transport electrode member between the first voltage state and the second voltage state.

5 Claims, 8 Drawing Sheets

(51) Int. Cl.
*H01J 49/42* (2006.01)
*H01J 49/06* (2006.01)

(58) Field of Classification Search
USPC ..... 250/281, 282, 283, 286, 287
See application file for complete search history.

(56) References Cited

U.S. PATENT DOCUMENTS

| | | | | |
|---|---|---|---|---|
| 6,188,066 | B1 | 2/2001 | Whitehouse et al. | |
| 6,897,439 | B1 | 5/2005 | Whitehouse et al. | |
| 7,176,455 | B1 | 2/2007 | Whitehouse et al. | |
| 9,929,001 | B2 * | 3/2018 | Asano | H01J 49/167 |
| 10,707,064 | B2 * | 7/2020 | Oguri | G01N 30/72 |
| 2001/0038069 | A1 | 11/2001 | Whitehouse et al. | |
| 2003/0034451 | A1 | 2/2003 | Whitehouse et al. | |
| 2004/0164240 | A1 | 8/2004 | Okumura et al. | |
| 2008/0121795 | A1 * | 5/2008 | Sugiyama | H01J 49/4225 250/282 |
| 2011/0303840 | A1 | 12/2011 | Whitehouse et al. | |
| 2011/0309244 | A1 | 12/2011 | Whitehouse et al. | |
| 2015/0144781 | A1 | 5/2015 | Howes et al. | |

FOREIGN PATENT DOCUMENTS

| | | | |
|---|---|---|---|
| EP | 1 467 397 | A2 | 10/2004 |
| EP | 1 533 829 | A2 | 5/2005 |
| EP | 1 533 830 | A2 | 5/2005 |
| EP | 0 748 249 | B1 | 7/2009 |
| ES | 2 331 494 | T3 | 12/1996 |
| JP | 7-220675 | A | 8/1995 |
| JP | 9-509781 | A | 9/1997 |
| JP | 2004-259452 | A | 9/2004 |
| WO | 95/023018 | A1 | 8/1995 |

OTHER PUBLICATIONS

Written Opinion for PCT/JP2017/025900 dated Oct. 17, 2017 [PCT/ISA/237].

* cited by examiner

MASS SPECTROMETER

CROSS REFERENCE TO RELATED APPLICATIONS

This application is a National Stage of International Application No. PCT/JP2017/025900 filed Jul. 18, 2017.

TECHNICAL FIELD

The present invention relates to a mass spectrometer that ionizes a sample containing a component to be measured and separates and detects the component to be measured according to a mass-to-charge ratio.

BACKGROUND ART

A liquid chromatograph mass spectrometer (LC-MS) includes a liquid chromatograph unit and a mass spectrometer. In the liquid chromatograph unit, a sample containing a component to be measured is temporally separated into components and sent to a mass spectrometer. In the mass spectrometer, each separated component is sequentially ionized in an ionization unit in a substantially atmospheric pressure. The ions generated here are sent by an ion guide or the like to an analysis chamber maintained in a high vacuum, are separated according to the mass-to-charge ratio m/z by a mass separation unit such as a multipole mass filter or the like disposed in the analysis chamber, and then are detected by a detector.

In the ionization unit, for example, an electrospray ionization (ESI) method is used. In the ESI method, a sample sent from a liquid chromatograph unit is introduced to an ESI probe and nebulized from its tip. At this time, the sample nebulized into microdroplets is charged by the voltage applied to the ESI probe, and the sample is ionized in the process of vaporizing the droplets. While such ionization is performed in the ionization unit, the generated ions are delivered to the mass separation unit by an ion guide or the like. Some of the charged microdroplets are also sent to the mass separation unit together with the ions. Therefore, there is a problem that the mass separation unit is contaminated with ions, charged microdroplets, and the like. Since the mass separation unit is a highly sophisticated unit and difficult to disassemble and clean, there is a strong demand for reducing the contamination as much as possible.

Therefore, conventionally, for example, a drain pipe is connected in the middle of a pipe through which a sample is sent from the liquid chromatograph unit to the ionization unit and by guiding the sample to the drain pipe with the switching valve in a time zone in which the component to be measured is not included in the sent sample, the sample is not introduced into the mass spectrometer, so that unnecessary contamination inside the device is prevented.

However, when the drain pipe is connected in this way, the switching valve in the pipe has a dead volume, and there is the problem that the components separated in the chromatograph unit diffuse again in the dead volume, and the peak intensity is lowered. In addition, the sample remaining in the dead volume causes a so-called carry-over that affects the next analysis.

In recent years, a technique has been widely used in which by setting the flow rate of the sample to be introduced into the ionization unit low and nebulizing the sample from an ultra-fine ESI probe, the size of the nebulized droplets is reduced, thereby improving ionization efficiency and increasing analysis sensitivity (so-called nano-ESI method).

In this case, when the flow rate of the sample is set low, the volume of the dead volume of the switching valve in the drain pipe becomes relatively large, so that the problem becomes remarkable.

In Patent Literature 1, in the ionization unit that performs ionization by the electrospray ionization method, the state of the ionization unit can be switched between a state of ionizing the sample (ionization state) and a state of draining the sample without the sample being ionized (non-ionization state) by changing at least one of the three parameter values: an ionization voltage, a nebulizer gas flow rate, and a cone gas flow rate. The ionization unit is left in a non-ionization state in the time zone in which the component to be measured is not contained in the sample sent, so that contamination of respective units arranged at a stage subsequent to the ionization unit is prevented.

CITATION LIST

Patent Literature

Patent Literature 1: US 2015/0144781 A

SUMMARY OF INVENTION

Technical Problem

In the technique of Patent Literature 1, when switching from a non-ionization state to an ionization state by changing a parameter value such as an ionization voltage, the ionization state is unstable for a while after the parameter value is changed. Also, in general, when the gas flow rate is changed, it takes time until the gas flow rate stabilizes at the changed flow rate (i.e. the responsiveness is low), so that the responsiveness of switching by changing the flow rate of nebulizer gas or cone gas is not good.

Therefore, in the technique of Patent Literature 1, it is necessary to estimate a sufficient time until stable ionization is performed after switching the ionization unit to the ionization state, and it is necessary to perform the switching in advance considering the time length (that is, at a timing sufficiently earlier than the time when the component to be measured starts to be introduced into the ionization unit). For this reason, respective units at a stage subsequent to the ionization unit will be unnecessarily contaminated during this time period.

Moreover, the ionization unit by the nano ESI method mentioned above is especially likely to be unstable during ionization, so that it is not preferable to frequently change the parameters. Therefore, in such a case, it is difficult to use the technique of Patent Literature 1 as a measure for preventing contamination in the device.

The present invention has been made in view of the above problems, and an object of the present invention is to provide a technique capable of reducing in-device contamination due to charged particles generated in an ionization unit in a mass spectrometer.

Solution to Problem

In the present invention made to solve the above problems, a mass spectrometer includes an ionization unit configured to ionize a sample containing a component to be measured, an ion transport unit configured to transport ions generated in the ionization unit, a mass separation unit configured to separate, according to a mass-to-charge ratio, the ions transported by the ion transport unit, wherein the ion transport unit includes a transport electrode member provided between the ionization unit and the mass separation unit, a voltage generator configured to apply a voltage to the transport electrode member, and a voltage controller configured to switch, by changing a voltage applied to the transport electrode member while ionization is performed in the ionization unit, between a first voltage state in which charged particles generated in the ionization unit can enter the mass separation unit and a second voltage state in which the charged particles generated in the ionization unit cannot enter the mass separation unit, and wherein the voltage controller switches a voltage state of the transport electrode member so that the voltage state is in the first voltage state in at least part of a time zone in which the component to be measured is introduced into the ionization unit, and the voltage state is in the second voltage state in at least part of a time zone in which the component to be measured is not introduced into the ionization unit.

In this configuration, "a voltage state in which charged particles generated in the ionization unit can enter the mass separation unit" is a voltage state in which an electric field is formed so that at least some of a group of charged particles generated in the ionization unit (desired charged particles, typically ions to be analyzed) is transported to the mass separation unit, so that some of the charged particles can enter the mass separation unit. In addition, "a voltage state in which charged particles generated in the ionization unit cannot enter the mass separation unit" is a voltage state in which most of the group of charged particles cannot enter the mass separation unit by forming an electric field that inhibits (or blocks) the transport of the group of charged particles generated in the ionization unit.

According to the above configuration, the transport electrode member is in the second voltage state in at least part of the time zone in which the component to be measured is not introduced into the ionization unit of the time zone in which the sample is introduced into the ionization unit and ionization is performed, so that contamination of the mass separation unit etc. placed at a stage subsequent to the ion transport unit is reduced in the at least part of the time zone. Since the voltage state of not the ionization unit but the transport electrode member placed in a stage subsequent to the ionization unit is switched, ionization does not become unstable before and after the switching. It should be noted that the change in voltage is more responsive than the change in gas flow rate. Further, unlike the ionization unit, the ion transport unit is less likely to have an unstable ion transport state event immediately after the voltage of the electrode member is changed. Therefore, a stable analysis operation can be performed immediately after switching the transport electrode member from the second voltage state to the first voltage stale. Therefore, it is possible to perform the switching, for example, at the time substantially same as the time when the component to be measured starts to be introduced into the ionization unit, and thus, contamination of the mass separation unit or the like is minimized.

Preferably, in the mass spectrometer, the transport electrode member is disposed in an intermediate vacuum chamber constituting a multistage differential exhaust system disposed between the ionization unit and the mass separation unit.

In this configuration, since the transport electrode member is disposed in the intermediate vacuum chamber maintained at a relatively low pressure by the multistage differential exhaust, the absolute value of the voltage required to form the second voltage state in which the charged particles generated in the ionization unit cannot enter the mass separation unit can be small. That is, it is possible to efficiently inhibit (or block) the ion transport with a relatively small voltage.

For example, when a plurality of ring-shaped electrodes surrounding the ion optical axis is arranged at equal intervals along the ion optical axis in the intermediate vacuum chamber (so-called ion funnel type ion guide), some or all of the plurality of ring-shaped electrodes may constitute the transport electrode member. Alternatively, when a plurality of (even number) rod electrodes (so-called multipole ion guide) extending in the direction of the ion optical axis is disposed in the intermediate vacuum chamber, some or all of the plurality of rod electrodes may constitute the transport electrode member.

Preferably, in the mass spectrometer, the transport electrode member is a communication unit having an opening for introducing charged particles generated in the ionization unit into an intermediate vacuum chamber constituting a multistage differential exhaust system disposed downstream of the ionization unit.

According to this configuration, the travel of the charged particles generated in the ionization unit can be blocked at the portion between the ionization unit and the intermediate vacuum chamber. Therefore, contaminated units can be minimized.

In each of the above configurations, by appropriately selecting the value of the DC voltage applied to the transport electrode member, an electric field can be formed between the transport electrode member and a member disposed adjacent to the transport electrode member (may be another transport electrode member), the electric field allowing at least some of the charged particles generated in the ionization unit to be efficiently transported to the mass separation unit. It is also possible to form an electric field that inhibits (or blocks) the charged particles generated in the ionization unit from being transported to the mass separation unit. That is, it is possible to switch between the first voltage state and the second voltage state by switching the value of the DC voltage applied to the transport electrode member.

Therefore, preferably, in the mass spectrometer, the voltage controller switches between the first voltage state and the second voltage state by changing a value of a DC voltage applied to the transport electrode member.

In each of the above configurations, when the transport electrode member includes a plurality of rod electrodes extending in the ion optical axis direction or a plurality of ring-shaped electrodes arranged in the ion optical axis direction, by appropriately selecting the radio-frequency voltage applied to the plurality of rod electrodes (or the plurality of ring-shaped electrodes), an electric field that converges the trajectory of ions can be formed in a space surrounded by the plurality of rod electrodes (or the plurality of ring-shaped electrodes). In addition, an electric field such that the ion trajectory diverges, not converges, and the ions cannot move forward can be formed in the space. That is, it is possible to switch between the first voltage state and the second voltage state by switching the value of the radio-frequency voltage applied to the transport electrode member.

Therefore, preferably, in the mass spectrometer, the transport electrode member includes a plurality of rod electrodes extending in a direction of an ion optical axis, or a plurality of ring-shaped electrodes arranged in the direction of the ion optical axis, and the voltage controller switches between the first voltage state and the second voltage state by changing a value of a radio-frequency voltage applied to the plurality of rod electrodes or the plurality of ring-shaped electrodes.

In addition, preferably, the mass spectrometer further includes a storage device that stores a first transition time point which is a time point, by a predetermined time period, before a scheduled time zone in which the component to be measured is introduced into the ionization unit, and a second transition time point which is a time point, by a predetermined time period, after the time zone, and the voltage controller switches a voltage state of the transport electrode member so that the voltage state is in the second voltage state in a time zone before the first transition time point and a time zone after the second transition time point, and is in the first voltage state in a time zone between the first transition time point and the second transition time point.

According to this configuration, for example, when the above predetermined time period is appropriately set in consideration of analysis conditions, the transport electrode member will be in the second voltage state in the entire time zone in which the component to be measured is considered not to be substantially introduced into the ionization unit, so that contamination of the mass separation unit or the like can be sufficiently reduced.

Advantageous Effects of Invention

According to this invention, by switching the voltage state of the transport electrode member arranged between the ionization unit and the mass separation unit, a state where charged particles do not reach the mass separation unit and the like arranged at a subsequent stage is formed, so that in-device contamination due to charged particles generated in the ionization unit can be reduced.

DESCRIPTION OF EMBODIMENTS

Figure 1:
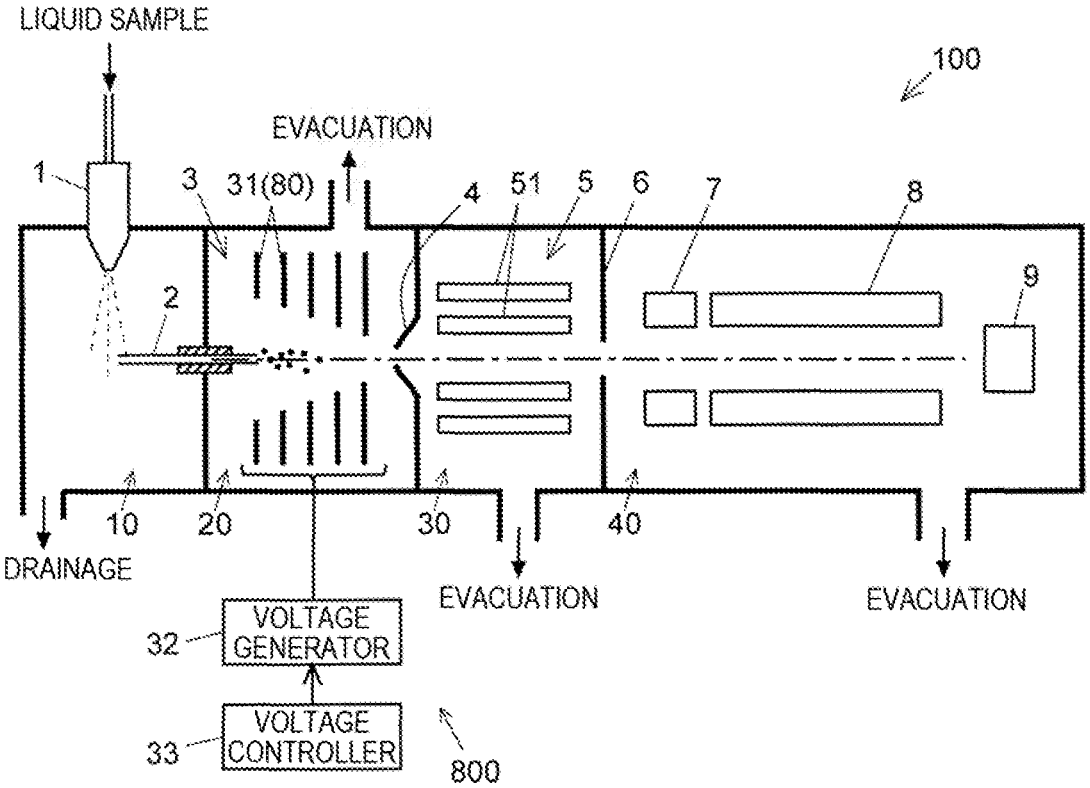
FIG. 1 is a schematic configuration diagram of a mass spectrometer according to an embodiment.

Hereinafter, embodiments of the present invention will be described with reference to the accompanying drawings. The following embodiments are an example embodying the present invention, and do not limit the technical scope of the present invention. Further, in the drawings, for convenience of explanation, only elements related to the present invention are shown, and illustration of some elements is omitted.

<1. Configuration of Mass Spectrometer>

The configuration of the mass spectrometer according to the embodiment will be described with reference to FIG. 1.

FIG. 1 is a schematic configuration diagram of a mass spectrometer 100 according to the embodiment.

The mass spectrometer 100 includes an ionization chamber 10 having a substantially atmospheric pressure atmosphere, an analysis chamber 40 maintained in a high vacuum atmosphere, and two intermediate vacuum chambers (a first intermediate vacuum chamber 20 and a second intermediate vacuum chamber 30) provided between the ionization chamber and the analysis chamber 40. Of these chambers (rooms) 10, 20, 30, and 40, the ionization chamber 10 has a substantially atmospheric atmosphere. The analysis chamber 40 is maintained in a high vacuum atmosphere by a high-performance vacuum pump (not shown) (for example, a turbo molecular pump). In addition, each of the intermediate vacuum chambers 20 and 30 is maintained at a predetermined pressure by being evacuated, and a multistage differential exhaust system is formed in which the degree of vacuum gradually increases as the pressure changes from the pressure in the ionization chamber 10 to the pressure in the analysis chamber 40 (the gas pressure decreases). Normally, the gas pressure in the first intermediate vacuum chamber 20 is about 10 to 100 [Pa], the gas pressure in the second intermediate vacuum chamber 30 is about 0.1 to 1 [Pa], and the gas pressure in the analysis chamber 40 is about $10^{-4}$ to $10^{-3}$ [Pa].

In the ionization chamber 10, an ionization unit 1 that ionizes a sample containing a component to be measured is provided. Specifically, the ionization unit 1 performs ionization by, for example, the ESI method and includes an ESI probe. A sample (sample whose components are temporally separated by a column in the chromatograph unit) is introduced into the ESI probe from the liquid chromatograph unit (not shown). The sample introduced into the ESI probe is nebulized into the ionization chamber 10 while being given unbalanced charges at the tip of the ESI probe, and the sample is ionized in the process of vaporizing the nebulized microdroplets.

The partition between the ionization chamber 10 and the first intermediate vacuum chamber 20 is provided with a communication pipe (ion introduction pipe) 2 that is a small-diameter tube (pipe), and the ionization chamber 10 and the first intermediate vacuum chamber 20 communicate with each other through the ion introduction pipe 2. Ions generated in the ionization unit 1 is entrained in the gas flow formed by the gas pressure difference between both ends of the ion introduction pipe 2 (the gas flow flowing into the ion introduction pipe 2), is sucked into the ion introduction pipe 2, and is introduced into the first intermediate vacuum chamber 20 through the ion introduction pipe 2.

The first intermediate vacuum chamber 20 is provided with an ion guide (first ion guide) 3 for sending ions introduced in first intermediate vacuum chamber 20 to the second intermediate vacuum chamber 30. The first ion guide 3 is composed of an ion funnel that is known as an ion transport optical system. That is, the first ion guide 3 includes a plurality of ring-shaped electrodes 31 arranged in a large number at equal intervals along the ion optical axis. The openings of the ring-shaped electrodes 31 are smaller toward downstream in the ion transport direction. By application of a predetermined voltage to each of the ring-shaped electrodes 31 to form a first voltage state V1 described later, ions that have flown into the space surrounded by the group of ring-shaped electrodes 31 are accelerated toward the second intermediate vacuum chamber 30, and pass through a small diameter orifice formed at the top of a skimmer 4 provided between the first intermediate vacuum chamber 20 and the second intermediate vacuum chamber 30 to be sent to the second intermediate vacuum chamber 30 (see FIG. 2A).

The second intermediate vacuum chamber 30 is provided with an ion guide (second ion guide) 5 for sending the ions introduced in the second intermediate vacuum chamber 30 to the analysis chamber 40. The second ion guide 5 is composed of a multipole ion guide that is known as an ion transport optical system. That is, the second ion guide 5 includes an even number (usually four or eight) of rod electrodes 51 extending in the ion optical axis direction. The rod electrodes 51 are arranged at equiangular intervals around the ion optical axis, for example, in a posture parallel to each other. By application of a predetermined voltage to each of the rod electrodes 51, ions that have flown into the space surrounded by the group of rod electrodes 51 are accelerated toward the analysis chamber 40, and pass through an opening formed in a partition 6 provided between the second intermediate vacuum chamber 30 and the analysis chamber 40 to be sent to the analysis chamber 40.

A pre rod electrode 7, a mass separation unit 8 formed by a quadrupole mass filter, and a detection unit 9 formed by an ion detector are provided in the analysis chamber 40. The ions introduced into the analysis chamber 40 are introduced, via the pre rod electrode 7, into the space in the long axis direction of the quadrupole mass filter, which is the mass separation unit 8, and only ions having a specific mass-to-charge ratio m/z selectively pass through the quadrupole mass filter to reach the detection unit 9, where the ions are detected.

In this way, in the mass spectrometer 100, respective elements provided between the ionization unit 1 and the mass separation unit 8 (the ion introduction pipe 2, the first ion guide 3, the skimmer 4, the second ion guide 5, the partition 6, the pre rod electrode 7, etc.) constitute an ion transport system for transporting ions generated by the ionization unit 1 to the mass separation unit 8. An ion transport unit 800 according to the present invention includes elements included in the ion transport system.

<2. Ion Transport Unit 800>

The mass spectrometer 100 includes a voltage generator 32 that applies a voltage to each of the ring-shaped electrodes 31 of the first ion guide 3, and a voltage controller 33 that is electrically connected to the voltage generator 32. In response to an instruction from the voltage controller 33, the voltage generator 32 applies the voltage instructed to the voltage generator 32 to each of the ring-shaped electrodes 31. The voltage controller 33 is a functional element realized in the control unit of the mass spectrometer 100, for example. The entity of the control unit is, for example, a personal computer in which required operating software (OS) is installed.

In this embodiment, all or some of the plurality of ring-shaped electrodes 31 constitute a transport electrode member 80 according to the present invention, and the ring-shaped electrodes 31, the voltage generator 32, and the voltage controller 33 constitute the ion transport unit 800) according to the invention.

The voltage controller 33 switches the voltage state between the first voltage state V1 and a second voltage state V2 by changing the voltage applied to the ring-shaped electrodes 31.

Here, the "first voltage state V1" is a voltage state in which charged particles (ions or charged microdroplets) generated in the ionization unit 1 can enter the mass separation unit 8. That is, it is a voltage state in which an electric field is formed so that at least some of a group of charged particles generated in the ionization unit 1 (desired charged particles, typically ions to be analyzed) is efficiently transported to the mass separation unit 8, so that part of the charged particles can enter the mass separation unit 8.

The "second voltage state V2" is a voltage state in which charged particles generated in the ionization unit 1 cannot enter the mass separation unit 8. That is, it is a voltage state in which an electric field that inhibits (or blocks) the transport of the group of charged particles generated in the ionization unit 1 is formed, so that most of the group of charged particles cannot enter the mass separation unit 8. Even in the second voltage state, there may be a situation in which some of the charged particles enter the mass separation unit 8, but its amount is extremely small. Therefore, as will become clear later, the contamination of the mass separation unit 8 can be greatly reduced as compared with a conventional mass spectrometer to which the present invention is not applied.

Hereinafter, each voltage state V1, V2 will be described in detail.

(First Voltage State V1)

The first voltage state V1 is formed by application of a predetermined DC voltage (bias voltage) and a predetermined radio-frequency voltage to a group of ring-shaped electrodes 31 arranged in the ion transport direction.

In the first voltage state V1, the DC voltage applied to each of the ring-shaped electrodes 31 forms an electric field that accelerates ions downstream, and in particular, a voltage that decreases (or increases) stepwise as it goes downstream in the ion transport direction is applied to each of the group of ring-shaped electrodes 31. Also, for example, when the DC voltage is applied, an electric field is formed in which ions are accelerated in part of the region, while ions are decelerated in different part of the region (that is, accelerated in the direction opposite to the direction where ions travel). In particular, a voltage is applied to each of a plurality of predetermined ring-shaped electrodes 31 in a group of ring-shaped electrodes 31 so as to decrease stepwise as it goes downstream in the ion transport direction, while a voltage is applied to each of a plurality of other ring-shaped electrodes 31 so as to increase stepwise as it goes downstream in the ion transport direction. Further, the DC voltage need not be different between the ring-shaped electrodes 31 (that is, a voltage that forms an electric field for accelerating (decelerating) ions). For example, the same voltage may be applied to all (or some) of the ring-shaped electrodes 31.

In short, the DC voltage applied to the ring-shaped electrodes 31 in the first voltage state V1 is any voltage that can efficiently transport the desired charged particles, and the specific values can be selected as appropriate in consideration of various conditions (desired charged particle mass-to-charge ratio (m/z), vacuum state (pressure) of the first intermediate vacuum chamber 20, the relationship between elements before and after (for example, the second ion guide 5 arranged in the subsequent stage and the ion introduction pipe 2 arranged in the previous stage), etc.).

In addition, the radio-frequency voltage applied to each of the ring-shaped electrodes 31 in the first voltage state V1, when applied, forms, in a frustoconical space surrounded by a group of ring-shaped electrodes 31, a radio-frequency electric field that converges the ion trajectory. In particular, this is a radio-frequency voltage whose phase is inverted between two adjacent ring-shaped electrodes 31.

Figure 2A:
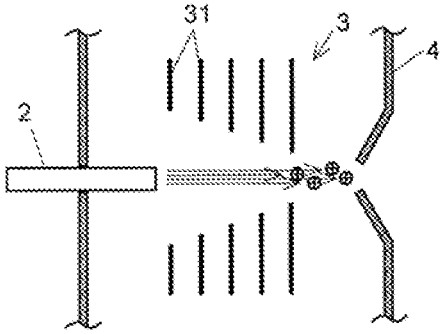
FIGS. 2A-2C are diagrams for explaining the movement of ions when the ring-shaped electrode is in the first voltage state or the second voltage state.

When the ring-shaped electrodes 31 are in the first voltage state V1 by application of the DC voltage and the radio-frequency voltage, ions that have flown into the space surrounded by the group of ring-shaped electrodes 31 are efficiently transported toward the second intermediate vacuum chamber 30 while being converged by the action of DC voltage and radio-frequency voltage applied to the ring-shaped electrodes 31 to be sent to the second intermediate vacuum chamber 30 (FIG. 2A). As described above, at least some of the ions sent to the second intermediate vacuum chamber 30 are introduced into the mass separation unit 8 via the second ion guide 5 and the pre rod electrode 7.

(Second Voltage State V2)

The second voltage state V2 is formed, for example, by application of a DC voltage having a polarity opposite to that of the first voltage state V1 to some or all of the group of ring-shaped electrodes 31 arranged in the ion transport direction. By application of such a DC voltage, an electric field that inhibits (or blocks) the transport of ions is formed in the space surrounded by the group of ring-shaped electrodes 31. Accordingly, ions cannot pass through the space (FIG. 2B) and cannot enter the downstream second intermediate vacuum chamber 30 or the downstream mass separation unit 8. Charged particles (charged droplets, etc.) other than ions show the same trend.

However, the DC voltage applied to each of the ring-shaped electrodes 31 in the second voltage state V2 is not limited to a voltage having a polarity opposite to that of the first voltage state V1. For example, the DC voltage may be a voltage at which, when applied, an electric field that excessively accelerates the ions and causes the ions to collide with some of the ring electrodes 31, the skimmer 4, and the like is formed. Also, for example, the DC voltage may be a voltage at which, when applied, an electric field that excessively decelerates ions (i.e., accelerate in the direction opposite to the direction in which ions travel) and causes the ions to collide with some of the ring electrodes 31, the ion introduction pipe 2, the inner wall of the first intermediate vacuum chamber, etc. is formed. Ions that collide with the ring-shaped electrodes 31 and the like are neutralized and disappear, or are exhausted as they are by a vacuum pump.

In short, the DC voltage applied to the ring-shaped electrodes 31 in the second voltage state V2 is any voltage that inhibits (or blocks) the transport of ions in the first intermediate vacuum chamber 20, thereby preventing the ions from reaching the second intermediate vacuum chamber 30 and the mass separation unit 8. The specific value can be appropriately selected in consideration of various conditions.

The second voltage state V2 may be formed such that in addition to (or instead of) the DC voltage as described above applied to each of the ring-shaped electrodes 31, the voltage value of the radio-frequency voltage applied to each of the ring-shaped electrodes 31 in the first voltage state V1 (radio-frequency voltages that are applied to two adjacent ring-shaped electrodes 31 and whose phases are mutually inverted) is zero (or a sufficiently small value).

In this case, a radio-frequency electric field for converging the ion trajectory is not formed in the space surrounded by the group of ring-shaped electrodes 31. Therefore, the ions that have flown into the space diverge without the trajectory being converged (FIG. 2C), collide with the ring electrode 31, the inner wall of the first intermediate chamber 20, etc., and are neutralized and disappear, or are exhausted as they are by a vacuum pump. That is, the ions cannot enter the downstream second intermediate vacuum chamber 30 or the downstream mass separation unit 8. Charged particles other than the ions show the same trend.

<3. Switching of Voltage State>

Figure 3:
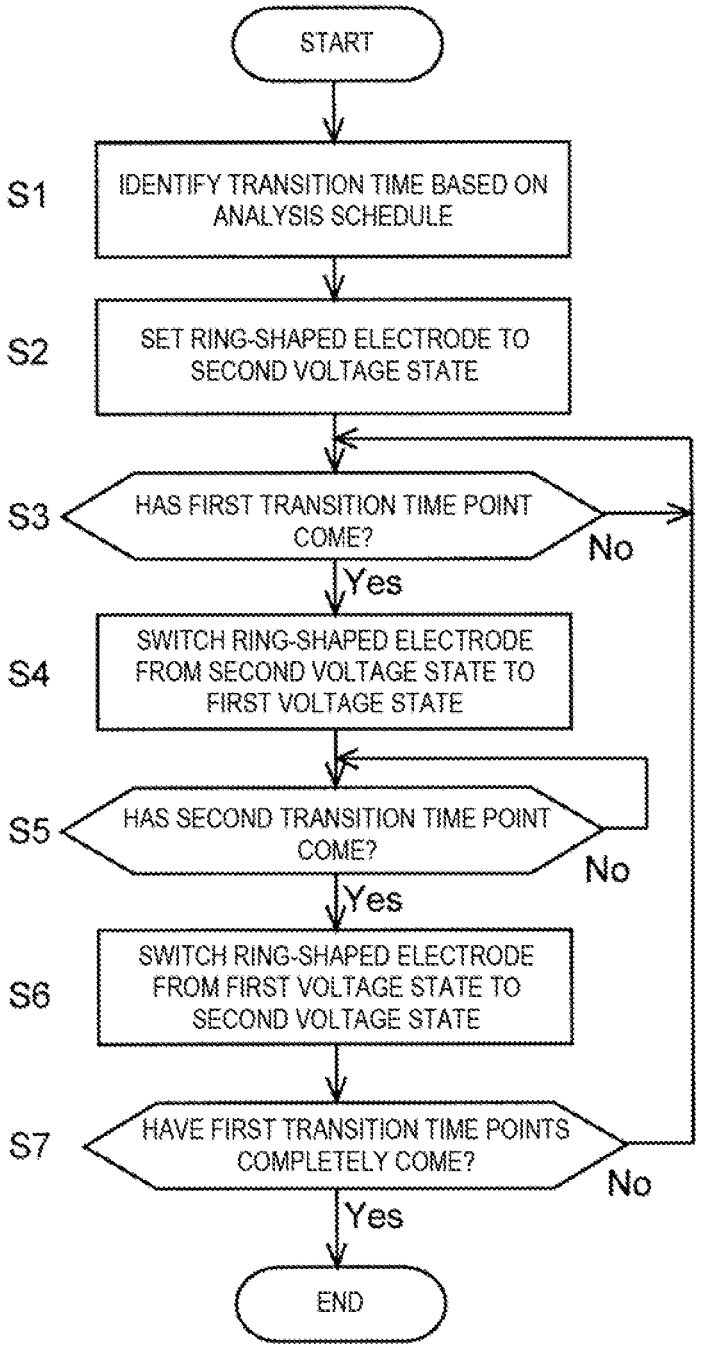
FIG. 3 is a flowchart of a process relating to voltage state switching.
Figure 4:
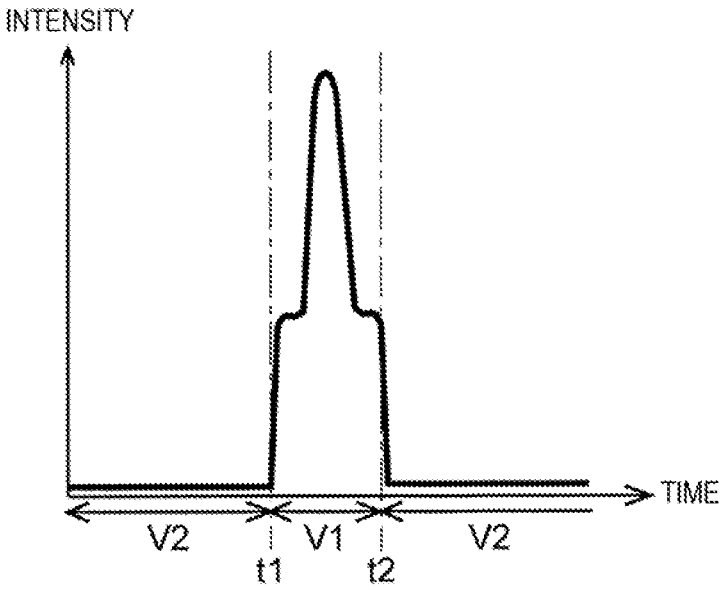
FIG. 4 is a diagram schematically showing a temporal change in detection intensity in an ion detector.

Next, the flow of a process relating to switching of the voltage state will be specifically described with reference to FIGS. 3 and 4. FIG. 3 is a flowchart of the process. FIG. 4 schematically shows a temporal change in the detection intensity at the detection unit 9 in the time zone in which the sample is introduced into the ionization unit 1.

In the mass spectrometer 100, an analysis schedule created based on an instruction input from a user or the like is stored in advance in a storage device of the control unit. In this analysis schedule, the time zones (scheduled introduction start time and scheduled introduction end time) at which the component to be measured is scheduled to be introduced into the mass spectrometer 100 within the time when the sample separated in time into each component is introduced from the liquid chromatograph unit to the ionization unit 1 are described. However, the time when the introduction of the component to be measured is actually started (ended) may slightly deviate from the scheduled time depending on the analysis conditions in the liquid chromatograph unit. Therefore, the voltage controller 33 refers to the analysis schedule, stores, as the first transition time point t1, the time point, by a predetermined time (for example, several tens of seconds to several minutes), before the scheduled start time of introduction specified for the component to be measured, and stores, as the second transition time point t2, the time point, by a predetermined time (for example, several tens of seconds to several minutes), after the scheduled end time of introduction (step S1). When there is a plurality of types of components to be measured, a plurality of sets of transition time points t1 and t2 are stored. Here, the voltage controller 33 refers to the analysis schedule and calculates the transition time points t1 and t2 and stores them in the storage device, but it may receive, for example, the input of the transition time points t and t2 from the analyst, and store them in a storage device.

Further, the voltage controller 33 sets the voltage state of the ring-shaped electrodes 31 as the second voltage state V2 before the introduction of the sample from the chromatograph unit is started (step S2).

Thereafter, when the introduction of the sample from the chromatograph unit is started, the sample is ionized in the ionization unit 1. The ionization unit 1 continues to perform ionization while the sample is introduced from the liquid chromatograph unit. Accordingly, while the sample is introduced from the liquid chromatograph unit into the ionization unit 1, ions generated in the ionization unit 1 and charged droplets are continuously introduced into the first intermediate vacuum chamber 20.

Figure 2B:
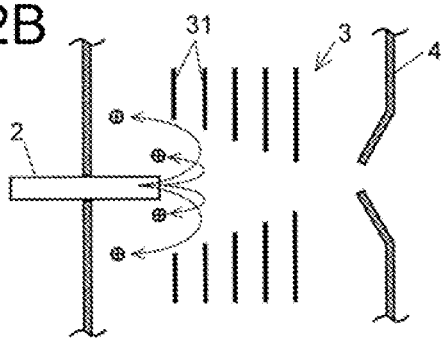
Figure 2C:
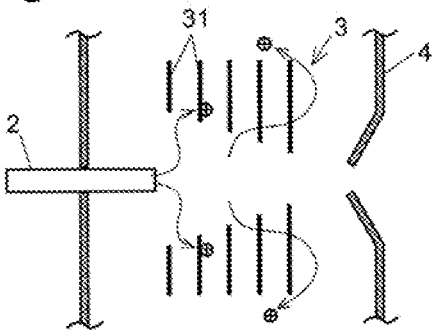

On the other hand, when the introduction of the sample is started, the voltage controller 33 determines whether the first transition time point t1 has come (step S3), and when it is determined that the first transition time point t has not come (NO in step S3), the voltage state of the ring-shaped electrodes 31 is kept at the second voltage state V2. At this time, the charged particles introduced into the first intermediate vacuum chamber 20 cannot enter the second intermediate vacuum chamber 30, and disappear in the first intermediate vacuum chamber 20 (FIGS. 2B and 2C). Therefore, contamination of respective units arranged at a stage subsequent to the first intermediate vacuum chamber 20 is reduced.

On the other hand, when it is determined that the first transition time point t1 has come (YES in step S3), the voltage controller 33 switches the voltage state of the ring-shaped electrodes 31 from the second voltage state V2 to the first voltage state V1 (step S4). After this switching is performed, the ions introduced into the first intermediate vacuum chamber 20 are accelerated toward the second intermediate vacuum chamber 30 while being converged here, and then pass through the orifice of the skimmer 4 to be sent to the second intermediate vacuum chamber 30 (FIG. 2A). The ions sent into the second intermediate vacuum chamber 30 are sent into the analysis chamber 40 while being converged by the second ion guide 5, where they are introduced into the space in the long axis direction of the quadrupole mass filter, which is the mass separation unit 8, and only ions having a specific mass-to-charge ratio m/z are selected and detected by the detection unit 9.

After step S4, the voltage controller 33 determines whether the second transition time point t2 has come (step S5), and when it is determined that the second transition time point t2 has come (YES in step S5), the voltage state of the ring-shaped electrodes 31 is switched from the first voltage state V1 to the second voltage state V2 (step S6). After this switching is performed, as described above, the charged particles introduced into the first intermediate vacuum chamber 20 cannot enter the second intermediate vacuum chamber 30, and contamination of respective units that are arranged at a stage subsequent to the first intermediate vacuum chamber 20 is reduced.

Subsequently, when the stored first transition time points t1 have not completely come (NO in step S7), the process returns to step S3 again. That is, the voltage controller 33 determines whether the first transition time point t1 related to the next component to be measured has come. When the first transition time points t1 have completely come (YES in step S7), the process ends.

In this way, in the above embodiment, the voltage controller 33 switches the voltage state of the ring-shaped electrodes 31 so that among the time zones when the sample is introduced into the ionization unit 1, the first voltage state V1 is set in the time zone in which the component to be measured is introduced into the ionization unit 1 (the time zone between the first transition time point t1 and the second transition time point t2), and the second voltage state V2 is set in the time zone in which the component to be measured is not introduced into the ionization unit 1 (the time zone before the first transition time point t1, and the time zone after the second transition time point t2). According to this configuration, when the above-mentioned predetermined time used for defining the transition time points t1 and t2 is appropriately set in consideration of analysis conditions, etc., since the ring-shaped electrodes 31 are set to the second voltage state V2 in the entire time zone in which the component to be measured is considered to be substantially not introduced into the ionization unit, contamination of respective units (the second ion guide 5, the pre rod electrode 7, the mass separation unit 8, the detection unit 9, etc.) arranged at a stage subsequent to the ring-shaped electrodes 31 can be sufficiently reduced.

However, not the entire time zone but only part of the time zone in which the component to be measured is not introduced into the ionization unit 1 may be set to the second voltage state V2. In addition, not the entire time zone but only part of the time zone in which the component to be measured is introduced into the ionization unit 1 may be set to the first voltage state V1. The ring-shaped electrodes 31 are set to the second voltage state V2 in at least part of the time zone in which the component to be measured is not included in the sample introduced into the ionization unit 1, so that it is possible to reduce contamination of respective units arranged at a stage subsequent to the ring-shaped electrodes 31 during the at least part of the time zone.

In the above embodiment, contamination of the ring-shaped electrodes 31 is not sufficiently avoidable. However, the ring-shaped electrodes 31 are easier to remove and clean than the mass separation unit 8, and when they are contaminated, they may be removed and cleaned.

In the above embodiment, since the parameter of the ionization unit 1 is not changed before and after the voltage state of the ring-shaped electrodes 31 is switched, ionization does not become unstable before and after the switching. Further, the change in voltage is more responsive than the change in gas flow rate. Further, even immediately after the voltage of the ring-shaped electrodes 31 is changed, the ion transport state is unlikely to become unstable. Therefore, ions reach the detection unit 9 immediately after switching the ring-shaped electrodes 31 from the second voltage state V2 to the first voltage state V1, and a stable analysis operation can be performed. Thus, for example, as in the above embodiment, it is possible to perform the switching at substantially the same timing as the time when the component to be measured is introduced into the ionization unit 1. As a result, it is possible to minimize contamination of respective units arranged at a stage subsequent to the ring-shaped electrodes 31.

<4. Modification>

<4-1. First Modification>

Figure 5:
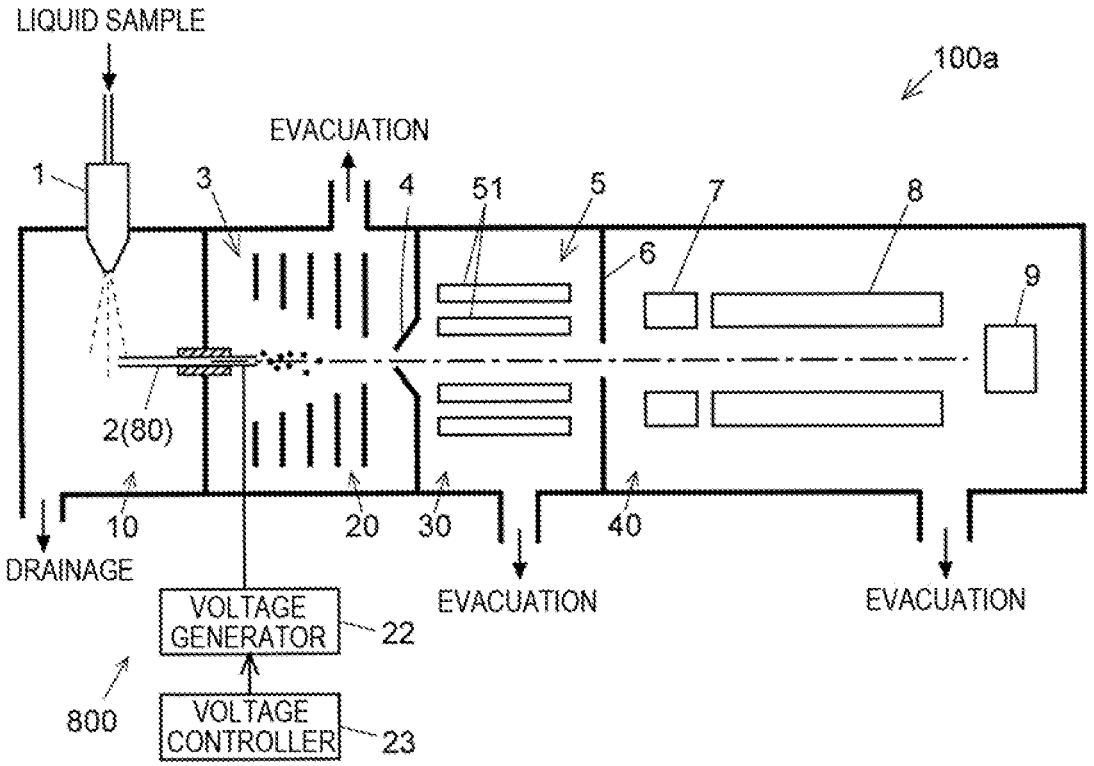
FIG. 5 is a schematic configuration diagram of a mass spectrometer according to a first modification.

A mass spectrometer 100*a* according to a first modification will be described with reference to FIG. 5. In the following modifications, the differences from the mass spectrometer 100) according to the above embodiment will be described, and the same elements as those of the mass spectrometer 100 will be denoted by the same reference numerals and description will be omitted.

The mass spectrometer 100*a* includes a voltage generator 22 that applies a voltage to the ion introduction pipe 2 and a voltage controller 23 that is electrically connected to the voltage generator 22. In response to an instruction from the voltage controller 23, the voltage generator 22 applies the voltage instructed to the voltage generator 22 to the ion introduction pipe 2.

In this modification, the ion introduction pipe 2 constitutes the transport electrode member 80 according to the present invention, and the ion introduction pipe 2, the voltage generator 22, and the voltage controller 23 constitute the ion transport unit 800 according to the present invention.

The voltage controller 23 switches the voltage state between the first voltage state V1 and the second voltage state V2 by changing the voltage applied to the ion introduction pipe 2. However, the voltage controller 23 switches the voltage state of the ion introduction pipe 2 by performing the same process as that performed by the voltage controller 33 described above (see FIG. 3).

Hereinafter, each voltage state V1, V2 will be described in detail.

(First Voltage State V1)

Figure 6A:
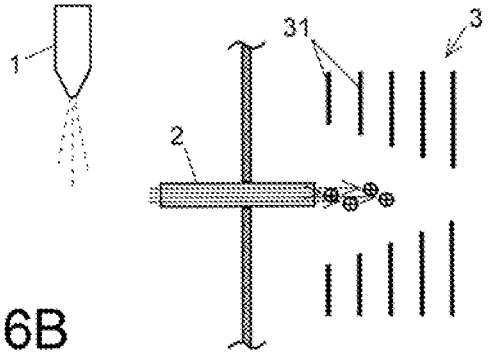
FIGS. 6A-6C are diagrams for explaining the movement of ions when the ion introduction pipe is in the first voltage state or the second voltage state.

Specifically, the first voltage state V1 is formed by setting the DC voltage applied to the ion introduction pipe 2 to zero. In this case, the ions introduced into the ion introduction pipe 2 are entrained in the gas flow and are sent to the first intermediate vacuum chamber 20 (FIG. 6A). At least some of the ions sent to the first intermediate vacuum chamber 20 are introduced into the mass separation unit 8 via the first ion guide 3, the second ion guide 5, and the pre rod electrode 7.

In the first voltage state V1, a DC voltage that is higher than the DC voltage applied to the ring electrodes 31 disposed in the first intermediate vacuum chamber 20 downstream of the ionization chamber 10 (when the ions generated in the ionization unit 1 are positive ions) or a DC voltage that is lower than the DC voltage (when the ions generated in the ionization unit 1 are negative ions) may be applied to the ion introduction pipe 2. In this case, the ions that have entered the ion introduction pipe 2 are accelerated by the action of the above DC voltage in addition to being entrained in the gas flow, and are sent to the first intermediate vacuum chamber 20.

(Second Voltage State V2)

Figure 6B:
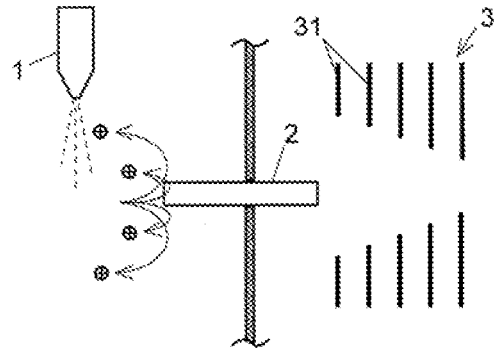

Specifically, the second voltage state V2 is formed by application of, to the ion introduction pipe 2, a DC voltage which has the same polarity as the ions generated in the ionization unit 1, and whose absolute value is tens to hundreds of volts (for example, when the generated ions are positive ions, a positive voltage of about +200 V, and when the generated ions are negative ions, a negative voltage of about −200 V). By application of such a DC voltage, the positive ions (negative ions) generated in the ionization unit 1 are subjected to the action of an excessive pushing-back electric field formed in the ionization chamber 10 by the positive voltage (negative voltage) applied to the ion introduction pipe 2, so that their entry into the ion introduction pipe 2 is blocked, and they cannot enter the downstream first intermediate vacuum chamber 20 or the downstream the mass separation unit 8 (FIG. 6B). Charged particles other than the ions show the same trend.

In this way, the DC voltage applied to the ion introduction pipe 2 in the second voltage state V2 is any voltage that forms an excessive pushing-back electric field that can block ions from entering the ion introduction pipe 2, and the specific value can be appropriately selected within the absolute value range of, for example, several tens to tens to hundreds of volts as described above.

In this modification, since the electric field in the ionization chamber 10 changes, the ionization state may change. However, the voltage applied to the ionization unit 1 is, for example, a high voltage of about 5 kV. The above-mentioned DC voltage applied to the ion introduction pipe 2 is sufficiently small, compared to this voltage, and the change in the ionization state is small enough to be negligible, compared to that of the conventional technology (for example, Patent Literature 1) in which the voltage applied to the ionization unit 1 is changed. That is, in the present invention, the first voltage state V and the second voltage state V2 may change at the time of switching in a range in which the ionization state in the ionization chamber 10 is sufficiently small (that is, the influence is negligibly small).

Figure 6C:
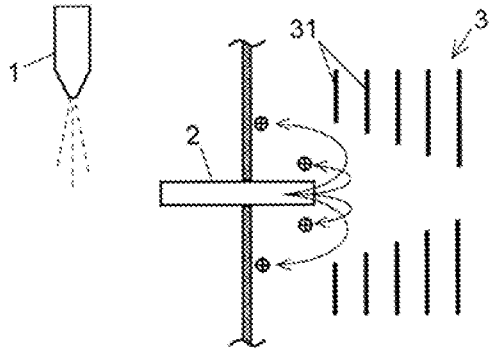

Further, the DC voltage that is applied to the ion introduction pipe 2 in the second voltage state V2 may be a DC voltage that is lower than the DC voltage applied to the ring electrodes 31 disposed in the first intermediate vacuum chamber 20 downstream of the ionization chamber 10 (when the ions generated in the ionization unit 1 are positive ions) or a DC voltage that is higher than the DC voltage (when the ions generated in the ionization unit 1 are negative ions). In this case, for example, the ions that have entered the ion introduction pipe 2 are pushed back by a pushing-back electric field formed between the ion introduction pipe 2 and the ring electrodes 31. Though they can reach part of the region of the first intermediate vacuum chamber 20, but cannot reach a downstream second vacuum chamber 30 and the downstream mass separation unit 8 (FIG. 6C).

According to the first modification, the traveling of ions generated in the ionization unit 1 can be blocked at the most upstream portion in the entire ion transport system provided between the ionization unit 1 and the mass separation unit 8. Therefore, contaminated units can be minimized.

In the above description, the ion introduction pipe 2 is a pipe-shaped unit. The ion introduction pipe 2 is any communication unit having an opening for introducing the ions generated in the ionization unit 1 into the downstream first intermediate chamber 20. For example, it may be shaped like an orifice, which is not pipe-shaped, or may be one aperture electrode.

<4-2. Second Modification>

Figure 7:
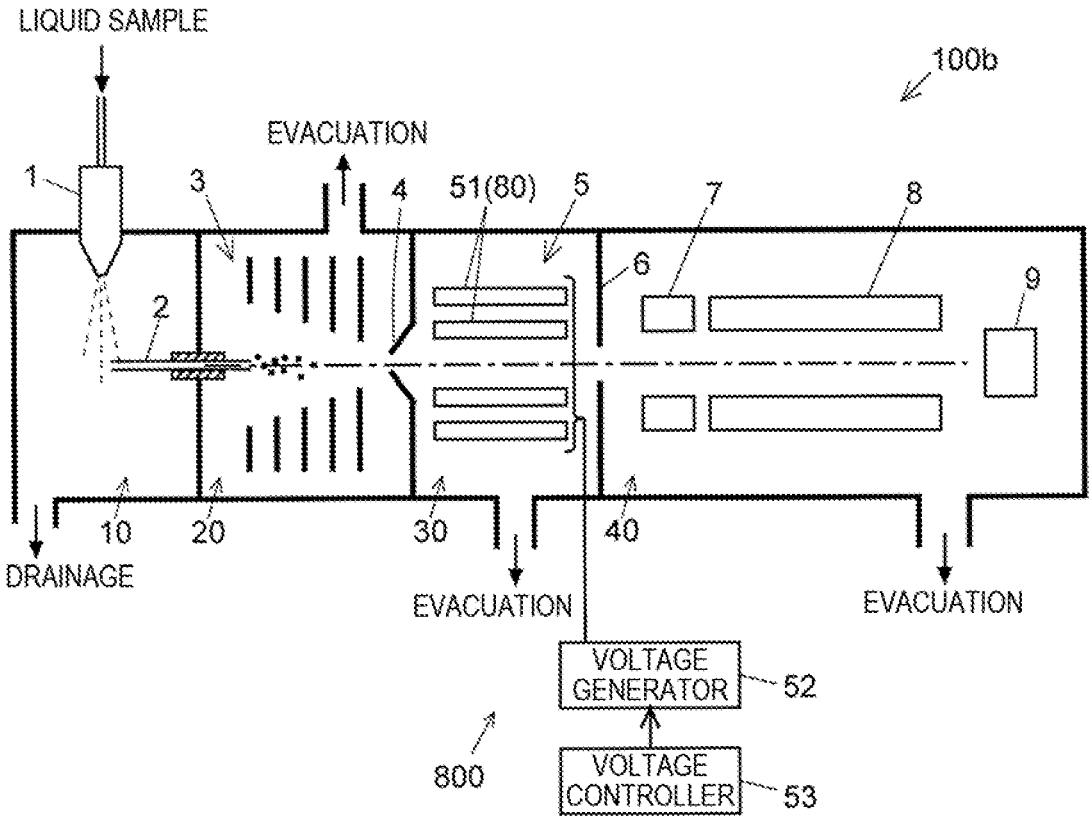
FIG. 7 is a schematic configuration diagram of a mass spectrometer according to a second modification.

A mass spectrometer 100*b* according to a second modification will be described with reference to FIG. 7.

The mass spectrometer 100*b* includes a voltage generator 52 that applies a voltage to the rod electrodes 51 included in the second ion guide 5, and a voltage controller 53 that is electrically connected to the voltage generator 52. In response to an instruction from the voltage controller 53, the voltage generator 52 applies the voltage instructed to the voltage generator 52 to the rod electrodes 51.

In this modification, all or some of the plurality of rod electrodes 51 constitute the transport electrode member 80 according to the present invention, and the rod electrodes 51, the voltage generator 52, and the voltage controller 53 constitute the ion transport unit 800 according to the present invention.

The voltage controller 53 switches the voltage state between the first voltage state V1 and the second voltage state V2 by changing the voltage applied to the rod electrodes 51. However, the voltage controller 53 switches the voltage state of the rod-shaped electrodes 51 by performing the same process as that performed by the voltage controller 33 described above (see FIG. 3).

Hereinafter, each voltage state V1, V2 will be described in detail.

(First Voltage State V1)

Figure 8A:
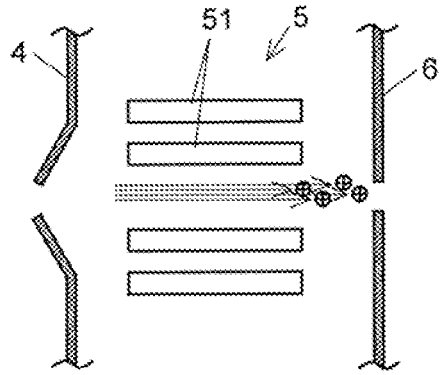
FIGS. 8A-8C are diagrams for explaining the movement of ions when the rod electrode is in the first voltage state or the second voltage state.

The first voltage state V1 is formed by application of radio-frequency voltages whose phases are reversed to the two adjacent rod electrodes 51. By application of such a radio-frequency voltage, a radio-frequency electric field that converges the trajectory of ions is formed in a space surrounded by the group of rod electrodes 51. Therefore, the ions that have flown into the space are transported toward the analysis chamber 40 while being converged here, and sent to the analysis chamber 40 (FIG. 8A). As described above, at least some of the ions sent to the analysis chamber 40 are introduced into the mass separation unit 8 via the pre rod electrode 7.

(Second Voltage State V2)

Figure 8B:
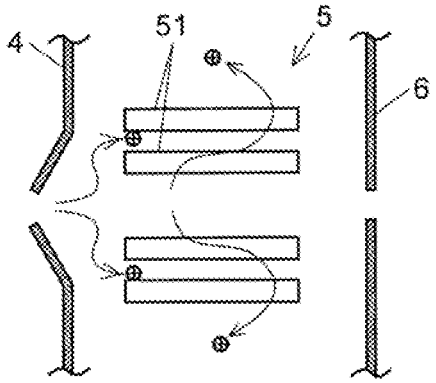

The second voltage state V2 is formed by setting, to zero (or a sufficiently small value), the voltage value of the radio-frequency voltage (the radio-frequency voltage that is applied to the two adjacent rod electrodes 51 and whose phases are inverted from each other) applied to each of the rod-shaped electrodes 51 in the first voltage state V1. In this case, a radio-frequency electric field that converges the trajectory of ions is not formed in the space surrounded by the group of rod electrodes 51. Therefore, the ions that have flown into the space diverge without the trajectory being converged (FIG. 8B), collide with the rod-shaped electrodes 51, the inner wall of a second intermediate chamber 30, etc., and are neutralized and disappear, or are exhausted as they are by a vacuum pump. That is, the ions cannot enter the downstream analysis chamber 40 or the downstream the mass separation unit 8. Charged particles other than the ions show the same trend.

Alternatively, the second voltage state V2 may be formed such that in addition to (or instead of) the radio-frequency voltage as described above applied to each of the rod-shaped electrodes 51, a predetermined DC voltage is applied.

Figure 8C:
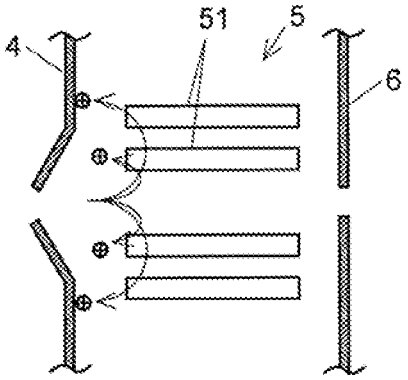

The DC voltage is a voltage at which, when applied, an electric field where ions cannot pass through the second intermediate chamber 30 is formed between the rod-shaped electrodes 51 and the electrode members before and after the rod-shaped electrodes 51 (i.e., the skimmer 4 and the partition 6). Specifically, for example, assuming that the incoming ions are positive ions, the voltage of the skimmer 4 is 0 V, and the voltage of the partition 6 is −1 V, an excessively large positive voltage of about +10 V is applied to each of the rod electrodes 51. As a result, positive ions that have entered the second intermediate vacuum chamber 30 are pushed back by the action of an excessive pushing-back electric field formed between the skimmer 4 and the rod electrodes 51 (FIG. 8C), and most of the ions collide with skimmer 4, are neutralized and disappear. Even when a few positive ions can reach the end of the rod electrodes 61, the positive ions are affected by an excessive acceleration electric field formed between the rod electrodes 51 and the partition 6, so that almost all of them collide with the partition 6, are neutralized and disappear.

That is, by application of such a DC voltage, an electric field that inhibits (or blocks) the transport of ions is formed in the internal space of the second intermediate vacuum chamber 30. Therefore, the ions cannot pass through the space and cannot enter the mass separation unit 8. Charged particles other than the ions show the same trend.

In this second modification, the rod-shaped electrodes 51 of the second ion guide 5 disposed in the second intermediate chamber 30 which is a region (that is, a high vacuum region) maintained at a relatively low pressure by the multistage differential exhaust serve as the transport electrode member 80. Therefore, for example, compared to the case where the member disposed in a region (that is, the low vacuum region) maintained at a relatively high pressure as in the first modification serves as the transport electrode member 80, it is possible to make the absolute value of the voltage (that is, the voltage that forms the second voltage state V2) necessary for inhibiting (or blocking) the ion transport small (for example, about 10 V). That is, it is possible to efficiently inhibit (or block) the ion transport with a relatively small voltage.

<4-3. Other Modification>

In the mass spectrometer 100, in addition to the ion introduction pipe 2, the ring-shaped electrodes 31, and the rod-shaped electrodes 51, various members provided between the ionization unit 1 and the mass separation unit 8 can serve as the transport electrode member 80. For example, the pre rod electrode 7, the skimmer 4, the partition 6, and the like can constitute the transport electrode member 80. In this case, for example, by switching the radio-frequency voltage or the DC voltage applied to each of the rod electrodes provided in the pre rod electrode 7, or by switching the DC voltage applied to the skimmer 4, or by switching the DC voltage applied to the partition 6, the first voltage state V1 and the second voltage state V2 can be switched.

Moreover, the embodiment and each modification may be implemented independently, and may be implemented in combination. That is, one or more elements selected from the ion introduction pipe 2, the ring-shaped electrodes 31, the skimmer 4, the rod electrodes 51, the partition 6, the pre rod electrode 7, and the like may constitute the transport electrode member 80. As described above, the closer the position of the transport electrode member 80 is to the ionization unit 1 (that is, the more upstream in the ion transport direction), the wider the range in which contamination is reduced. In addition, as described above, the lower the pressure in the space where the transport electrode member 80 is disposed (that is, the more downstream in the ion transport direction), the more effective the shielding of charged particles by voltage, so that it is possible to inhibit (or block) the ion transport with the low voltage.

REFERENCE SIGNS LIST

100, 100*a*, 100*b* . . . Mass Spectrometer
10 . . . Ionization Chamber
20 . . . First Intermediate Vacuum Chamber
30 . . . Second Intermediate Vacuum Chamber
40 . . . Analysis Chamber
1 . . . Ionization Unit
2 . . . Ion Introduction Pipe
22 . . . Voltage Generator
23 . . . Voltage Controller
3 . . . First Ion Guide
31 . . . Ring-Shaped Electrode
32 . . . Voltage Generator
33 . . . Voltage Controller
4 . . . Skimmer
5 . . . Second Ion Guide
51 . . . Rod Electrode
52 . . . Voltage Generator
53 . . . Voltage Controller
6 . . . Partition
7 . . . Pre Rod Electrode
8 . . . Mass Separation Unit
9 . . . Detection Unit
800 . . . Ion Transport Unit
80 . . . Transport Electrode Member
V1 . . . First Voltage State
V2 . . . Second Voltage State

The invention claimed is:

1. A mass spectrometer comprising:

an ionization unit configured to ionize a sample containing a component to be measured;

an ion transport unit configured to transport ions generated in the ionization unit;

a mass separation unit configured to separate, according to a mass-to-charge ratio, the ions transported by the ion transport unit; and a storage device that stores a first time point which is a predetermined time before a scheduled time period in which the component to be measured is introduced into the ionization unit, and a second time point which is a predetermined time after the scheduled time period, wherein the ion transport unit includes:

a transport electrode member provided between the ionization unit and the mass separation unit;

a voltage generator configured to apply a voltage to the transport electrode member; and a voltage controller configured to switch, by changing a voltage applied to the transport electrode member while ionization is performed in the ionization unit, between a first voltage state in which charged particles generated in the ionization unit are capable of entering the mass separation unit and a second voltage state in which the charged particles generated in the ionization unit are not capable of entering the mass separation unit, and wherein the voltage controller switches a voltage state of the transport electrode member so that the voltage state is in the second voltage state in a time period before the first time point and in a time period after the second time point, and the voltage state is in the first voltage state in a time period between the first time point and the second time point.

2. The mass spectrometer according to claim 1, wherein the transport electrode member is disposed in an intermediate vacuum chamber constituting a multistage differential exhaust system disposed between the ionization unit and the mass separation unit.

3. The mass spectrometer according to claim 1, wherein the transport electrode member is a communication unit having an opening for introducing charged particles generated in the ionization unit into an intermediate vacuum chamber constituting a multistage differential exhaust system disposed downstream of the ionization unit.

4. The mass spectrometer according to claim 1, wherein the voltage controller switches between the first voltage state and the second voltage state by changing a value of a DC voltage applied to the transport electrode member.

5. The mass spectrometer according to claim 1, wherein the transport electrode member includes a plurality of rod electrodes extending in a direction of an ion optical axis, or a plurality of ring-shaped electrodes arranged in the direction of the ion optical axis, and wherein the voltage controller switches between the first voltage state and the second voltage state by changing a value of a radio-frequency voltage applied to the plurality of rod electrodes or the plurality of ring-shaped electrodes.

* * * * *